US010076701B2

(12) United States Patent
Mercer et al.

(10) Patent No.: US 10,076,701 B2
(45) Date of Patent: Sep. 18, 2018

(54) RIM-MOUNTED ROULETTE BALL LAUNCHING SYSTEM

(71) Applicant: Bally Gaming, Inc., Las Vegas, NV (US)

(72) Inventors: Haven A. Mercer, Excelsior, MN (US); Troy D. Nelson, Big Lake, MN (US); James P. Helgesen, Eden Prairie, MN (US); Jamal Hani Kotifani, Eden Prairie, MN (US); Georg Fekete, Korneuburg (AT); James B. Stasson, Chaska, MN (US); Ronald R. Swanson, Otsego, MN (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/099,174

(22) Filed: Apr. 14, 2016

(65) Prior Publication Data

US 2017/0087450 A1 Mar. 30, 2017

Related U.S. Application Data

(63) Continuation-in-part of application No. 14/865,592, filed on Sep. 25, 2015.

(51) Int. Cl.

| | |
|---|---|
| ***A63F 1/18*** | (2006.01) |
| ***A63F 11/00*** | (2006.01) |
| ***A63F 5/00*** | (2006.01) |

(52) U.S. Cl.

CPC ..... *A63F 11/00* (2013.01); *A63F 5/00* (2013.01)

(58) Field of Classification Search

CPC ... A63F 5/00; A63F 5/02; G03B 21/00; G07F 17/32

USPC ..... 273/142 F, 142 E, 143 R, 142 A, 142 D, 273/142 G, 148 R, 129 V

See application file for complete search history.

(56) References Cited

U.S. PATENT DOCUMENTS

| | | | | |
|---|---|---|---|---|
| 1,527,876 A | | 2/1925 | Janik | |
| 1,537,236 A | | 5/1925 | Jarvis | |
| 2,104,740 A | * | 1/1938 | Evans | G07F 17/3213 273/142 E |
| 2,490,802 A | | 12/1949 | Hanff | |

(Continued)

FOREIGN PATENT DOCUMENTS

| | | |
|---|---|---|
| EP | 0160157 A2 | 11/1985 |
| ES | 1077627 U | 8/2012 |

(Continued)

OTHER PUBLICATIONS

International Search Report from PCT International Application No. PCT/US2016/052816, dated Dec. 14, 2016, 5 pages.

(Continued)

*Primary Examiner* — Melba Bumgarner
*Assistant Examiner* — Joseph B Baldori
(74) *Attorney, Agent, or Firm* — TraskBritt

(57) ABSTRACT

A ball-launching system mounts to a top rim of a roulette wheel and positions a ball launcher configured to launch a roulette ball into the roulette wheel. The ball-launching system includes an outer jaw and an inner jaw, which clamp to the top rim. At least a part of a ball launcher extends into a concave bowl of the roulette wheel and facilitates launching the roulette ball directly into a ball track underneath the top rim within the concave bowl.

6 Claims, 10 Drawing Sheets

(56) References Cited

U.S. PATENT DOCUMENTS

| | | | | |
|---|---|---|---|---|
| 3,084,680 | A | 4/1963 | Goldfarb et al. | |
| 3,142,292 | A | 7/1964 | Suchland | |
| 3,364,787 | A | 1/1968 | Miller | |
| 3,511,225 | A | 5/1970 | Yokoi | |
| 3,610,223 | A | 10/1971 | Green | |
| 3,853,324 | A | 12/1974 | Reiner et al. | |
| 3,870,307 | A | 3/1975 | Meyer et al. | |
| 4,010,953 | A | 3/1977 | Russo | |
| 4,262,648 | A | 4/1981 | Wegener et al. | |
| 4,337,945 | A * | 7/1982 | Levy | A63F 5/00 273/129 S |
| 4,471,746 | A | 9/1984 | Ando | |
| 4,643,425 | A * | 2/1987 | Herzenberger | A63F 5/00 273/142 B |
| 4,735,416 | A * | 4/1988 | McNally | A63F 5/0005 273/125 A |
| 4,754,980 | A * | 7/1988 | Torgow | A63F 7/0058 200/61.11 |
| 4,869,505 | A * | 9/1989 | Manabe | A63F 5/00 273/142 B |
| 5,042,810 | A | 8/1991 | Williams | |
| 5,048,832 | A | 9/1991 | Kaminkow | |
| 5,261,851 | A | 11/1993 | Siebert, Jr. | |
| 5,326,103 | A * | 7/1994 | Lund | A63F 7/027 273/118 R |
| 5,415,150 | A | 5/1995 | Dallas | |
| 5,501,457 | A | 3/1996 | Ogihara | |
| 5,588,650 | A | 12/1996 | Eman et al. | |
| 5,636,838 | A * | 6/1997 | Caro | A63F 5/04 273/142 E |
| 5,687,967 | A | 11/1997 | Klaus | |
| 5,718,431 | A | 2/1998 | Ornstein | |
| 5,743,798 | A | 4/1998 | Adams et al. | |
| 5,743,800 | A | 4/1998 | Huard et al. | |
| 5,836,583 | A * | 11/1998 | Towers | A63F 5/00 273/142 B |
| 5,857,451 | A | 1/1999 | Ciluffo et al. | |
| 5,975,527 | A | 11/1999 | Winchester | |
| 5,980,399 | A | 11/1999 | Campbell et al. | |
| 6,019,095 | A | 2/2000 | Sommer et al. | |
| 6,059,659 | A | 5/2000 | Busch et al. | |
| 6,083,105 | A | 7/2000 | Ronin et al. | |
| 6,089,215 | A | 7/2000 | Morris et al. | |
| 6,099,417 | A | 8/2000 | Brown et al. | |
| 6,159,112 | A | 12/2000 | Ciluffo et al. | |
| 6,379,257 | B1 | 4/2002 | Skleba et al. | |
| 6,520,854 | B1 | 2/2003 | McNally | |
| 6,616,530 | B2 * | 9/2003 | Pearce | A63F 5/00 463/17 |
| 6,659,866 | B2 | 12/2003 | Frost et al. | |
| 6,755,741 | B1 | 6/2004 | Rafaeli | |
| 7,383,832 | B2 | 6/2008 | Soberg | |
| 7,661,676 | B2 | 2/2010 | Smith et al. | |
| 7,669,853 | B2 | 3/2010 | Jones | |
| 7,674,172 | B2 * | 3/2010 | Miltenberger | A63F 5/00 273/142 E |
| 7,806,788 | B1 | 10/2010 | Neuman | |
| 7,815,187 | B2 * | 10/2010 | Yokota | A63F 5/00 273/142 E |
| 7,841,597 | B2 | 11/2010 | Cammegh | |
| 7,901,285 | B2 | 3/2011 | Tran et al. | |
| 7,926,810 | B2 | 4/2011 | Fisher et al. | |
| 7,934,980 | B2 | 5/2011 | Blaha et al. | |
| 7,988,548 | B2 | 8/2011 | Okada | |
| 8,028,993 | B2 | 10/2011 | Witty | |
| 8,152,170 | B2 | 4/2012 | Yokota et al. | |
| D663,785 | S | 7/2012 | Walsh et al. | |
| 8,272,958 | B2 | 9/2012 | Smith et al. | |
| 8,282,100 | B2 * | 10/2012 | Kido | A63F 5/0005 273/142 E |
| 8,286,619 | B2 | 10/2012 | Mihaljevic | |
| 8,381,709 | B2 | 2/2013 | Woessner et al. | |
| 8,439,360 | B2 * | 5/2013 | Kido | A63F 5/0005 273/143 R |
| 8,511,682 | B2 * | 8/2013 | Yokota | A63F 5/00 273/142 R |
| 8,517,382 | B1 * | 8/2013 | Pagliuca | A63F 5/00 273/142 E |
| 8,899,586 | B2 | 12/2014 | Shelburn et al. | |
| 9,067,119 | B1 | 6/2015 | Vaught et al. | |
| 9,259,631 | B2 | 2/2016 | Gowan et al. | |
| 9,266,014 | B2 | 2/2016 | Dayal et al. | |
| 9,452,340 | B2 | 9/2016 | Vaught et al. | |
| 2003/0060263 | A1 | 3/2003 | Pearce et al. | |
| 2005/0020347 | A1 | 1/2005 | Moshal | |
| 2005/0164759 | A1 | 7/2005 | Smith et al. | |
| 2005/0164762 | A1 | 7/2005 | Smith et al. | |
| 2005/0192076 | A1 | 9/2005 | Lowery | |
| 2008/0139079 | A1 | 6/2008 | Siebert | |
| 2008/0242184 | A1 | 10/2008 | Divnick | |
| 2010/0120487 | A1 | 5/2010 | Walker et al. | |
| 2011/0214652 | A1 | 9/2011 | Woessner et al. | |
| 2013/0053117 | A1 | 2/2013 | Snow | |
| 2013/0059638 | A1 | 3/2013 | Nicely | |
| 2013/0184059 | A1 | 7/2013 | Costello et al. | |
| 2013/0184079 | A1 | 7/2013 | Costello et al. | |
| 2013/0214486 | A1 * | 8/2013 | Shelburn | A63F 5/0088 273/142 E |
| 2014/0094244 | A1 | 4/2014 | Baron et al. | |
| 2014/0345585 | A1 | 11/2014 | Allen et al. | |
| 2014/0370980 | A1 | 12/2014 | Czyzewski et al. | |
| 2015/0157927 | A1 | 6/2015 | Shelburn et al. | |
| 2016/0250536 | A1 | 9/2016 | Hart | |

FOREIGN PATENT DOCUMENTS

| | | | |
|---|---|---|---|
| ES | 1087979 | U | 8/2013 |
| FR | 2775910 | A1 | 9/1999 |
| JP | 2015029801 | A | 2/2015 |
| TW | 201023954 | A | 7/2010 |
| WO | 2008153505 | A2 | 12/2008 |
| WO | 20100141736 | A1 | 12/2010 |
| WO | 2014188025 | A | 11/2014 |
| WO | 2014189936 | A1 | 11/2014 |

OTHER PUBLICATIONS

International Written Opinion from PCT International Application No. PCT/US2016/052816, dated Dec. 14, 2016, 6 pages.

* cited by examiner

RIM-MOUNTED ROULETTE BALL LAUNCHING SYSTEM

CROSS-REFERENCE TO RELATED APPLICATIONS

This application is a continuation-in-part of co-pending U.S. patent application Ser. No. 14/865,592, filed Sep. 25, 2015, the disclosure of which is hereby incorporated herein in its entirety by this reference. The subject matter of this application is also related to U.S. patent application Ser. No. 15/073,498 filed Mar. 17, 2016, pending, and to U.S. patent application Ser. No. 15/276,642 filed Sep. 26, 2016, also pending.

COPYRIGHT

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever.

TECHNICAL FIELD

This disclosure relates generally to methods of administering wagering games for casinos and other gaming establishments, and related systems and apparatuses, and more particularly to wagering games where wagers are risked on roulette ball spins and the final positions of the roulette balls on the roulette wheel.

BACKGROUND

Roulette is a popular wagering game played in casinos and other gaming establishments. Avid players are generally open to, and sometimes specifically seek out, new and more interesting ways to play roulette, particularly when the reward for a winning outcome at the end of a round of play, or the odds of achieving a winning outcome, may be enhanced. In addition, casino operators are always seeking new, eye-catching roulette systems and improvements that can leverage their existing facilities to better advantage.

Generally, the popularity of gaming machines and systems that present roulette games to players is dependent on the likelihood (or perceived likelihood) of winning money at the machine or table and the intrinsic entertainment value of the system relative to other available gaming options. Where the available gaming options include a number of competing systems and the expectation of winning at each gaming system is roughly the same (or believed to be the same), players are likely to be attracted to the most entertaining and exciting systems. Shrewd operators consequently strive to employ the most entertaining and exciting games, features, and enhancements available because such offerings attract frequent play and hence increase profitability to the operator. Therefore, there is a continuing need for gaming machine manufacturers to continuously develop new games and improved gaming enhancements that will attract frequent play through enhanced entertainment value to the player.

BRIEF SUMMARY

According to one embodiment of the present disclosure, a roulette ball launching system includes a mounting structure fixed to a top rim of a roulette wheel bowl. The mounting structure releasably clamps the top rim between an outer jaw and an inner jaw. The launching system further includes an automatic roulette ball launcher connected to the mounting structure that is configured to launch a roulette ball into a ball path of the roulette wheel bowl from underneath the top rim.

According to another embodiment of the present disclosure, a roulette ball launching system is mounted to a roulette table that includes a roulette wheel in a concave bowl with a circular ball path around an upper circumference of the concave bowl below a top rim. The launching system includes a mounting structure fixed to the top rim via the top rim being clamped between an outer jaw and an inner jaw. The launching system further includes a roulette ball launcher connected to the mounting structure. The ball launcher positions a roulette ball within the circular ball track prior to releasing the roulette ball into the circular ball track.

According to still another embodiment of the present disclosure, a roulette ball launching system is mounted to a roulette table that includes a roulette wheel in a concave bowl with a top rim. The roulette table further includes a circular ball track around an upper circumference of the bowl below the tip rim. The launching system includes a mounting structure including a downward-facing outer jaw and a downward-facing inner jaw. The mounting structure is configured to be fixed to the top rim of the bowl via the top rim being clamped between the outer and inner jaws. The launching system further includes a roulette ball launcher connected to the mounting structure having a launch position and a retracted position. In the launch position, at least a part of the ball launcher extends into the bowl below the top rim. In the retracted position, the at least a part of the ball launcher is withdrawn out of the bowl. The ball launcher in the launch position is configured to release the roulette ball within the circular ball track underneath the rim.

Additional embodiments of the present disclosure will be apparent to those of ordinary skill in the art in view of the detailed description of various embodiments, which is made with reference to the drawings, a brief description of which is provided below.

BRIEF DESCRIPTION OF THE DRAWINGS

The drawings described below have been timely submitted with this specification and are incorporated herein by reference in their entirety.

Figure 1:
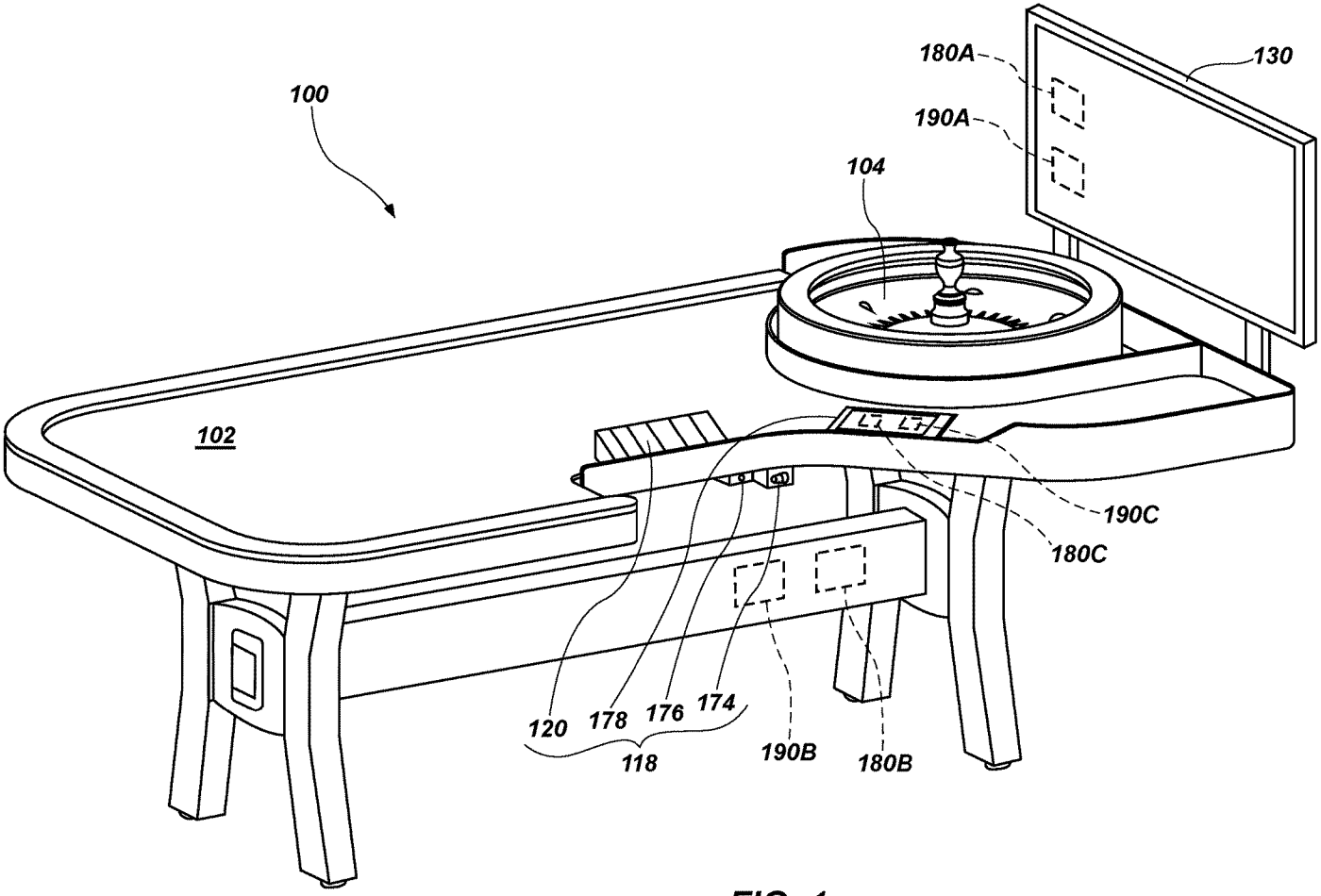
FIG. 1 is a perspective view of an exemplary roulette table that may be utilized to administer a roulette game.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

The illustrations presented in this disclosure are not meant to be actual views of any particular act and/or element in a method, apparatus, system, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix should be considered as multiple instantiations of substantially similar elements and may be referred to generically without an alphabet character suffix.

The terms "gaming," "gambling," or the like, refer to activities, games, sessions, rounds, hands, rolls, operations, and other events related to wagering games, the outcome of which is at least partially based on one or more random events ("chance" or "chances"), and on which wagers may be placed by a player. In addition, the words "wager," "bet," "bid," or the like, refer to any type of wager, bet, or gaming venture that is placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that involve the risk of real-world monetary value for the potential of payouts with real-world monetary value (e.g., the "play-for-pay," such as "house-banked" and "player-banked," configurations, each of which is described in more detail below) or in wagering games that involve no real-world monetary risks for the player (e.g., the "play-for-fun" and "social play-for-fun" configurations described in more detail below).

As used herein, the term "wager" includes any form of wagering value, including money, casino chips, other physical means for payment, and online or remote electronic authorization of a wager in any acceptable form to the casino or online or virtual game host. Also included are physical representations of money (e.g., casino chips) at a local game, as well as virtual representations of money in the form of electronic authorizations of a transfer of money and digital representations of money (e.g., digital representations of bills or coins, digital representations of chips, numerical quantities of money, numerical quantities of points, or numerical quantities of credits) at a local or remote electronic gaming device. As used herein, the term "wagering element" means and includes objects and symbols used to signify the acceptance of a wager. For example, physical wagering elements include physical money (e.g., bills and coins) and physical wagering tokens (e.g., casino chips), which may or may not be redeemable for monetary value and may or may not include electronic identifiers (e.g., RFID chips) embedded within the tokens, enabling electronic sensing and tracking of wagering. Virtual wagering elements include, for example, images (e.g., images of money or poker chips) and text (e.g., a string of numbers), which may or may not be redeemable for monetary value. In the "play-for-fun" and "social play-for-fun" configurations, a "wager" may not have a cash value (i.e., a real-world monetary value).

For the purposes of this description, it will be understood that when an action related to accepting wagers, generating roulette outcomes, making payouts, accepting selection of roulette outcomes, or other actions associated with a player or a croupier is described herein, and such description includes a player or a croupier taking the action, some results of the action may be computer generated and may be displayed on a live or virtual table or electronic display, and, if applicable, the reception or detection of such an action in an electronic form where player and croupier choices, selections, or other actions are received at an electronic interface. Also included is the representation of the present disclosure and corresponding physical roulette wheel on a display or displays, and, if applicable to the action described, an electronic reception of an indication that the roulette outcome has been received, selected, or otherwise interacted with at a location associated with a player, or, associated with a virtual player. A wagering game may also be implemented with a virtual or computer-generated dealer, croupier, or table manager.

Various platforms are contemplated that are suitable for implementation of embodiments of wagering games according to this disclosure. For example, embodiments of wagering games may be implemented as live table games with an in-person croupier, partially or fully automated table games, and partially or fully automated, network-administered games (e.g., Internet games) wherein game results may be produced utilizing a live video feed of a croupier administering a game from a remote studio.

For example, in one embodiment, the players may be remotely located from a live croupier, and a live croupier and a roulette table may be displayed to players on their monitors via a video feed. The players' video feeds may be transmitted to the croupier and may also be shared among the players at the table. In a sample embodiment, a central station may include a plurality of betting-type game devices and an electronic camera for each game device. A plurality of player stations, remotely located with respect to the central station, may each include a monitor for displaying a selected game device at the central station, and input means for selecting a game device and for placing a bet by a player at the player's station relating to an action involving an element of chance to occur at the selected game device. Further details on gambling systems and methods for remotely-located players are disclosed in U.S. Pat. No. 6,755,741 B1, issued Jun. 29, 2004, titled "GAMBLING GAME SYSTEM AND METHOD FOR REMOTELY-LOCATED PLAYERS," the disclosure of which is incorporated herein in its entirety by this reference.

FIG. 1 is a perspective view of an embodiment of a roulette table 100 configured for implementation of embodiments of wagering games in accordance with the present disclosure. The table 100 may include a playing surface 102, which may be, for example, a felt layout or an electronic display. The table 100 may further include a physical roulette wheel 104 proximate to, and in some embodiments supported by, the playing surface 102. The table 100 may include a video display 130 configured to display game information, such as, for example, the information described subsequently in connection with FIG. 2, and any other information considered useful to the players, including acceptance of wagers, game outcomes, wager outcomes, payout multipliers, historical game outcome data, and other information, in real-time.

In some embodiments, the playing surface 102 may include an electronic bet sensor to electronically recognize the placement of a specific type of chip (e.g., bonus wager or conventional roulette wager) of a fixed denomination. In some embodiments, the electronic bet sensor may also be configured to determine the denomination of the chip. In still other embodiments, the electronic bet sensor may be able to detect one or more denominations of a plurality of stacked chips included in the wager. In some embodiments, the wager can be any size within house limits.

The table 100 may include features for at least partially automating administration of a wagering game using the table 100. For example, the table 100 may include a croupier interface 118, which may enable an in-person administrator (e.g., a croupier) to initiate automated administration of certain actions and to personally perform other actions associated with administering a wagering game. The croupier interface 118 may include, for example, a croupier chip tray 120, which may be configured to support house chips, to which lost wagers may be added, and from which payouts may be paid. The croupier interface 118 may include a player authenticator 174 (e.g., a magnetic strip reader for cards carrying player information encoded on a magnetic strip), which may be configured to verify the identity of a player and grant access to a player account for the purpose of paying payouts, granting complimentary items and services (i.e., "comps") to players, redeeming chips for monetary value and vice versa, or performing other actions requiring a player's verified identity. The croupier interface 118 may include game initiation and control devices, such as, for example, buttons 176 and touchscreens 178, which may be configured to initiate random game events, verify authorization for large payout awards, enter wagering or outcome information for the purpose of game tracking, activating and deactivating automated portions of game administration (e.g., turning the table 100 and associated components on and off), and performing other actions to initiate and control the automatic administration of the wagering game.

The table 100 may include at least one processor, for example, a processor 180A-180C, which may be associated, for example, with the video display 130 (e.g., processor 180A), the table 100 itself (e.g., processor 180B), or the touchscreen 178 (e.g., processor 180C) of the croupier interface 118. The one or more processors 180A-180C may access game rules and game assets (e.g., videos, images, and text) stored in at least one nontransitory memory, such as a memory 190A-190C, which may similarly be associated, for example, with the video display 130 (e.g., memory 190A), the table 100 itself (e.g., memory 190B), or the touchscreen 178 (e.g., memory 190C) of the croupier interface 118. For example, the one or more processors 180A-180C may interpret a random game outcome, declare winning wager conditions, and control display of information on the video display 130.

At least some of the actions performed in connection with administering a wagering game using the table 100 may be accomplished by an in-person croupier. For example, wagers may be accepted by a croupier permitting a player to place a chip in a designated area on the playing surface 102, and payouts may be paid by the croupier giving chips from a croupier chip tray 120 to a player, for example, by placing them on the playing surface 102 proximate the player. Other actions performed in connection with administering a wagering game using the table 100 may be accomplished automatically by one or more processors 180A-180C, which may occur in response to croupier input or may occur automatically in response to other game events. For example, one or more processors 180A-180C may automatically interpret a random game outcome (e.g., using sensors in the physical roulette wheel 104 or using imaging sensors configured to capture information from the physical roulette wheel 104), and may apply game rules and display all winning game conditions associated with the random game outcomes on the video display 130.

Figure 2:
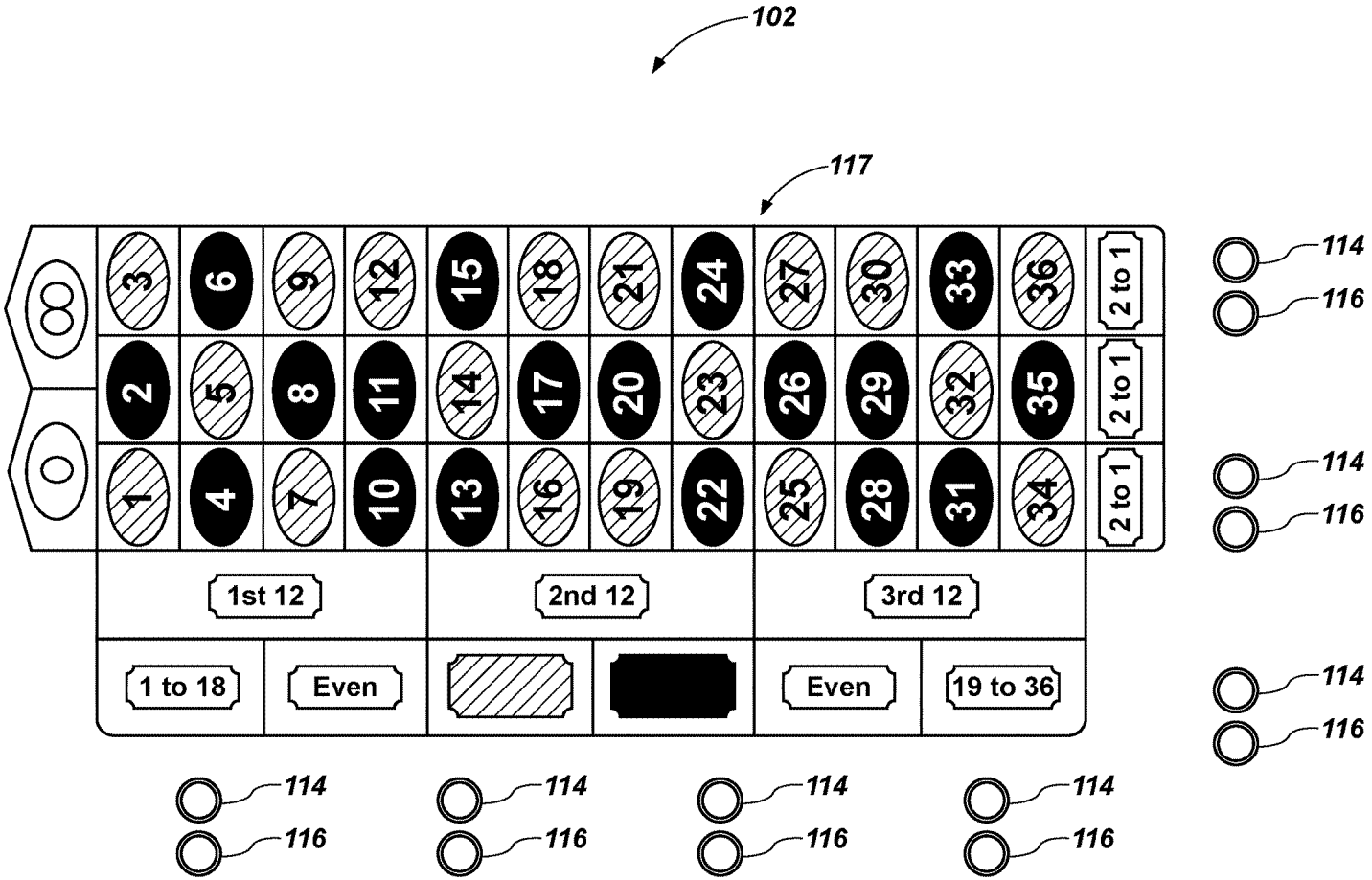
FIG. 2 is a diagram of an exemplary playing surface for administering a roulette game.

FIG. 2 is a diagram of an exemplary playing surface 102 for implementing wagering games within the scope of this disclosure. Such an implementation may be, for example, a felt layout on a physical gaming table or an electronic representation on an electronic display. The playing surface 102 may also include roulette wager areas 114, 116 at multiple player positions from which wagering elements associated with conventional roulette wagering may be retrieved.

The playing surface 102 may further include a wagering area 117, in which conventional roulette wagers, and any other wagers may be accepted. The wagering area 117 may be the same as or similar to wagering areas described in U.S. patent application Ser. No. 13/631,598, filed Sep. 28, 2012, for "SYSTEMS, METHODS, AND DEVICES FOR DISPLAYING HISTORICAL ROULETTE INFORMATION." Briefly, the wagering area 117 may be configured for acceptance of bonus, odds, evens, red, black, split, box, specific number and color, and other roulette bets, wherein the receipt of a wagering element within a specific area, on a border between areas, or at an intersection among areas may reflect receipt of a predicted roulette outcome or a predicted characteristic of a roulette outcome. In some embodiments, the playing surface 102 may include an area for electronically showing the outcome of randomly generated roulette outcomes or a roulette wheel into which a ball may be introduced to randomly generate a roulette outcome.

Figure 3:
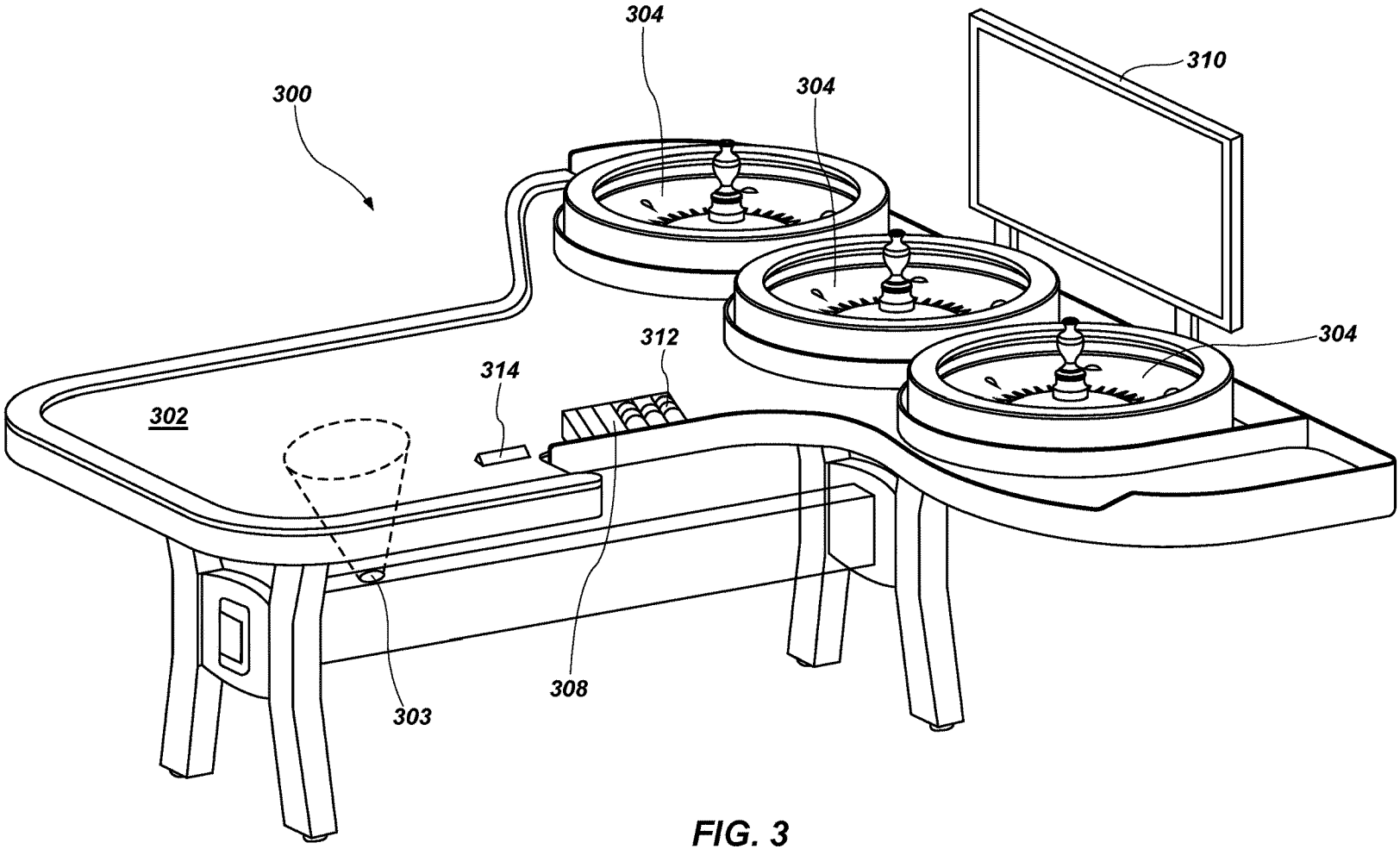
FIG. 3 is a perspective view of an exemplary multi-wheel roulette table.

FIG. 3 is a perspective view of an embodiment of a gaming table 300 for implementing wagering games in accordance with this disclosure. The gaming table 300 may be a physical article of furniture around which participants in the wagering game may stand or sit and on which the physical objects used for administering and otherwise participating in the wagering game may be supported, positioned, moved, transferred, and otherwise manipulated. For example, the gaming table 300 may include a gaming surface 302 on which the physical objects used in administering the wagering game may be located. The gaming surface 302 may be, for example, a felt fabric covering a hard surface of the table 300, and a design, conventionally referred to as a "layout," specific to the game being administered may be physically printed on the gaming surface 302. As another example, the gaming surface 302 may be a surface of a transparent or translucent material (e.g., glass or plexiglass) onto which a projector 303, which may be located, for example, above or below the gaming surface 302, may illuminate a layout specific to the wagering game being administered. In such an example, the specific layout projected onto the gaming surface 302 may be changeable, enabling the gaming table 300 to be used to administer different variations of wagering games within the scope of this disclosure or other wagering games. Additional details of illustrative gaming surfaces and projectors are disclosed in U.S. patent application Ser. No. 13/919,849, filed Jun. 17, 2013, and titled "ELECTRONIC GAMING DISPLAYS, GAMING TABLES INCLUDING ELECTRONIC GAMING DISPLAYS AND RELATED ASSEMBLIES, SYSTEMS AND METHODS," the disclosure of which is incorporated herein in its entirety by this reference. In either example, the gaming surface 302 may include, for example, designated areas for player positions; areas in which wagering elements of specific types may be stored; areas in which wagers may be accepted; areas in which wagers may be grouped into pots; and areas in which rules, pay tables, and other instructions related to the wagering game may be displayed. As a specific, nonlimiting example, the gaming surface 302 may be configured as shown in FIG. 2.

In some embodiments, the gaming table 300 may include a display 310 separate from the gaming surface 302. The display 310 may be configured to face players, prospective players, and spectators and may display, for example, rules, paytables, real-time game status, such as wagers accepted and cards dealt, historical game information, such as amounts won, amounts wagered, percentage of hands won, and notable hands achieved, and other instructions and information related to the wagering game. The display 310 may be a physically fixed display, such as a poster, in some embodiments. In other embodiments, the display 310 may change automatically in response to a stimulus (e.g., may be an electronic video monitor).

The gaming table 300 may include particular machines and apparatuses configured to facilitate the administration of the wagering game. For example, the gaming table 300 may include one or more physical roulette wheels 304. More specifically, the gaming table 300 may include three separate roulette wheels 304, which may generate independently randomized roulette outcomes. The roulette wheels 304 may include, for example, a spinning, recessed surface (e.g., a wheelhead) with a series of numbered and colored pockets into which an outcome identifier (e.g., a ball) may come to rest. The outcome identifiers may be manually introduced into the roulette wheels 304 by a croupier or may be automatically introduced into the roulette wheels 304 by identifier introduction mechanisms. The roulette wheels 304 may simply be supported on the gaming surface 302 in some embodiments. In other embodiments, the roulette wheels 304 may be mounted into the gaming surface 302 such that the roulette wheels 304 are not manually removable from the gaming surface 302 without the use of tools.

The gaming table 300 may include one or more chip racks 308 configured to facilitate accepting wagers, transferring lost wagers to the house, and exchanging monetary value for wagering elements 312 (e.g., chips). For example, the chip rack 308 may include a series of token support rows, each of which may support tokens of a different type (e.g., color and denomination). In some embodiments, the chip rack 308 may be configured to automatically present a selected number of chips using a chip-cutting-and-delivery mechanism. Additional details of an illustrative chip rack 308 and chip-cutting-and-delivery mechanism are found in U.S. Pat. No. 7,934,980, issued May 3, 2011, to Blaha et al., the disclosure of which is incorporated herein in its entirety by this reference. In some embodiments, the gaming table 300 may include a drop box 314 for money that is accepted in exchange for wagering elements 312. The drop box 314 may be, for example, a secure container (e.g., a safe or lockbox) having a one-way opening into which money may be inserted and a secure, lockable opening from which money may be retrieved. Such drop boxes 314 are known in the art, and may be incorporated directly into the gaming table 300 and may, in some embodiments, have a removable container for the retrieval of money in a separate, secure location.

When administering a wagering game in accordance with embodiments of this disclosure, a croupier may receive money (e.g., cash) from a player in exchange for wagering elements 312. The croupier may deposit the money in the drop box 314 and transfer physical wagering elements 312 to the player. The croupier may accept one or more initial wagers (e.g., antes and other wagers) from the player, which may be reflected by the croupier permitting the player to place one or more wagering elements 312 or other wagering tokens (e.g., cash) within designated areas on the gaming surface 302 associated with the various wagers of the wagering game. Once all wagers have been accepted, outcome identifiers may be introduced into the roulette wheels 304 and permitted to come to rest on three individually randomized roulette outcomes.

Finally, the croupier may resolve the wagers, award payouts to the players, which may be accomplished by giving wagering elements 312 from the chip rack 308 to the players, resetting progressive wagers, which may be accomplished by transferring wagering elements 312 designated for placing the progressive wagers to players or transferring them to the chip rack 308, and transferring losing, nonprogressive wagers to the house, which may be accomplished by moving wagering elements 312 from the gaming surface 302 to the chip rack 308.

Figure 4:
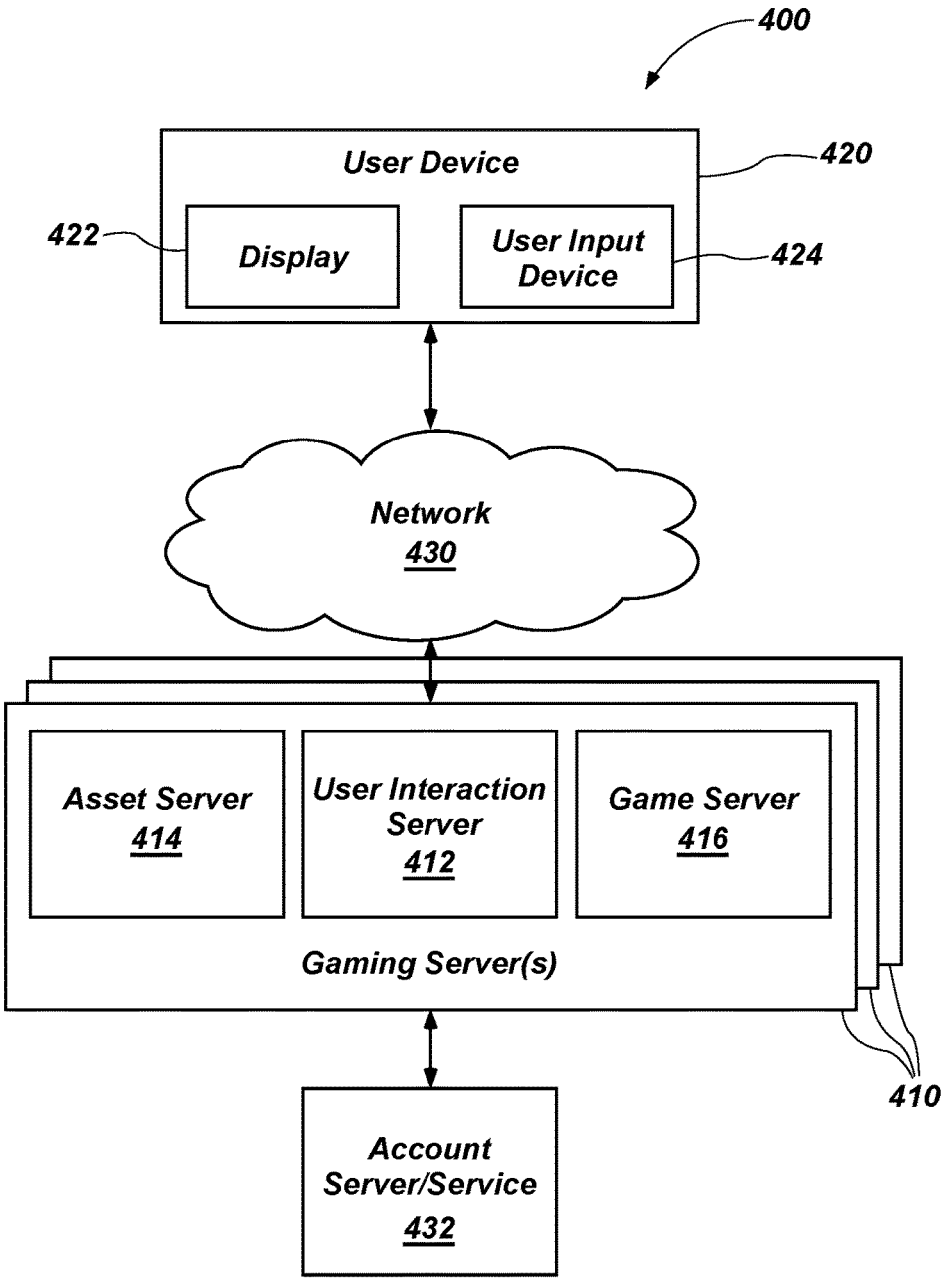
FIG. 4 is a schematic block diagram of a gaming system for implementing embodiments of roulette games in accordance with this disclosure.

In some embodiments, wagering games in accordance with this disclosure may be administered using a gaming system employing a client-server architecture (e.g., over the Internet, a local area network, etc.). FIG. 4 is a schematic block diagram of an illustrative gaming system 400 for implementing wagering games according to this disclosure. The gaming system 400 may enable end users to remotely access game content. Such game content may include, without limitation, various types of wagering games such as card games, dice games, big wheel games, roulette, scratch off games ("scratchers"), and any other wagering game where the game outcome is determined, in whole or in part, by one or more random events. This includes, but is not limited to, Class II and Class III games as defined under 25 U.S.C. § 2701 et seq. ("Indian Gaming Regulatory Act"). Such games may include banked and/or non-banked games.

The wagering games supported by the gaming system 400 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 400 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 400 may include a gaming platform to establish a portal for an end user to access a wagering game hosted by one or more gaming servers 410 over a network 430. In some embodiments, games are accessed through a user interaction server 412. The gaming system 400 enables players to interact with a user device 420 through a user input device 424 and a display 422 and to communicate with one or more gaming servers 410 using a network 430 (e.g., the Internet). Typically, the user device 420 is remote from the gaming server 410 and the network is the word-wide web (i.e., the Internet).

In some embodiments, the gaming servers 410 may be configured as a single server to administer wagering games in combination with the user device 420. In other embodiments, the gaming servers 410 may be configured as separate servers for performing separate, dedicated functions associated with administering wagering games. Accordingly, the following description also discusses "services" with the understanding that the various services may be performed by different servers or combinations of servers in different embodiments. As shown in FIG. 4, the gaming servers 410 may include a user interaction server 412, a game server 416, and an asset server 414. In some embodiments, one or more of the gaming servers 410 may communicate with an account server 432 performing an account service 432. As explained more fully below, for some wagering type games, the account service 432 may be separate and operated by a different entity than the gaming servers 410; however, in some embodiments the account service 432 may also be operated one or more of the gaming servers 410.

The user device 420 may communicate with the user interaction server 412 through the network 430. The user interaction server 412 may communicate with the game server 416 and provide game information to the user device 420. In some embodiments, the game server 416 may also include a game engine. The game engine may, for example, access, interpret, and apply game rules. In some embodiments, a single user device 420 communicates with a game provided by the game server 416, while other embodiments may include a plurality of user devices 420 configured to communicate and provide end users with access to the same game provided by the game server 416. In addition, a plurality of end users may be permitted to access a single user interaction server 412, or a plurality of user interaction services 412, to access the game server 416. The user interaction server 412 may enable a user to create and access a user account and interact with game server 416. The user interaction server 412 may enable users to initiate new games, join existing games, and interface with games being played by the user.

The user interaction server 412 may also provide a client for execution on the user device 420 for accessing the gaming servers 410. The client provided by the gaming servers 410 for execution on the user device 420 may be any of a variety of implementations depending on the user device 420 and method of communication with the gaming servers 410. In one embodiment, the user device 420 may connect to the gaming servers 410 using a web browser, and the client may execute within a browser window or frame of the web browser. In another embodiment, the client may be a stand-alone executable on the user device 420.

For example, the client may comprise a relatively small amount of script (e.g., JAVASCRIPT®), also referred to as a "script driver," including scripting language that controls an interface of the client. The script driver may include simple function calls requesting information from the gaming servers 410. In other words, the script driver stored in the client may merely include calls to functions that are externally defined by, and executed by, the gaming servers 410. As a result, the client may be characterized as a "thin client." The client may simply send requests to the gaming servers 410 rather than performing logic itself. The client may receive player inputs, and the player inputs may be passed to the gaming servers 410 for processing and executing the wagering game. In some embodiments, this may involve providing specific graphical display information for the display 422 as well as game outcomes.

As another example, the client may comprise an executable file rather than a script. The client may do more local processing than does a script driver, such as calculating where to show what game symbols upon receiving a game outcome from the game server 416 through user interaction server 412. In some embodiments, portions of an asset server 414 may be loaded onto the client and may be used by the client in processing and updating graphical displays. Some form of data protection, such as end-to-end encryption, may be used when data is transported over the network 430. The network 430 may be any network, such as, for example, the Internet or a local area network.

The gaming servers 410 may include an asset server 414, which may host various media assets (e.g., text, audio, video, and image files) to send to the user device 420 for presenting the various wagering games to the end user. In other words, the assets presented to the end user may be stored separately from the user device 420. For example, the user device 420 requests the assets appropriate for the game played by the user; as another example, especially relating to thin clients, just those assets that are needed for a particular display event will be sent by the gaming servers 410, including as few as one asset. The user device 420 may call a function defined at the user interaction server 412 or asset server 414, which may determine which assets are to be delivered to the user device 420 as well as how the assets are to be presented by the user device 420 to the end user. Different assets may correspond to the various user devices 420 and their clients that may have access to the game server 416 and to different variations of wagering games.

The gaming servers 410 may include the game server 416, which may be programmed to administer wagering games and determine game play outcomes to provide to the user interaction server 412 for transmission to the user device 420. For example, the game server 416 may include game rules for one or more wagering games, such that the game server 416 controls some or all of the game flow for a selected wagering game as well as the determined game outcomes. The game server 416 may include pay tables and other game logic. The game server 416 may perform random number generation for determining random game elements of the wagering game. In one embodiment, the game server 416 may be separated from the user interaction server 412 by a firewall or other method of preventing unauthorized access to the game server 412 by the general members of the network 430.

The user device 420 may present a gaming interface to the player and communicate the user interaction from the user input device 424 to the gaming servers 410. The user device 420 may be any electronic system capable of displaying gaming information, receiving user input, and communicating the user input to the gaming servers 410. For example, the user device 420 may be a desktop computer, a laptop, a tablet computer, a set-top box, a mobile device (e.g., a smartphone), a kiosk, a terminal, or another computing device. As a specific, nonlimiting example, the user device 420 operating the client may be an interactive electronic gaming system. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 410. The client may be illustrated within a casino webpage (or other interface) indicating that the client is embedded into a webpage, which is supported by a web browser executing on the user device 420.

In some embodiments, components of the gaming system 400 may be operated by different entities. For example, the user device 420 may be operated by a third party, such as a casino or an individual, that links to the gaming servers 410, which may be operated, for example, by a wagering game service provider. Therefore, in some embodiments, the user device 420 and client may be operated by a different administrator than the operator of the game server 416. In other words, the user device 420 may be part of a third-party system that does not administer or otherwise control the gaming servers 410. In other embodiments, the user interaction server 412 and asset server 414 may be operated by a third-party system. For example, a gaming entity (e.g., a casino) may operate the user interaction server 412, user device 420, or combination thereof to provide its customers access to game content managed by a different entity that may control the game server 416, amongst other functionality. In still other embodiments, all functions may be operated by the same administrator. For example, a gaming entity (e.g., a casino) may elect to perform each of these functions in-house, such as providing access to the user device 420, delivering the actual game content, and administering the gaming system 400.

The gaming servers 410 may communicate with one or more external account servers 432 (also referred to herein as an account service 432), optionally through another firewall. For example, the gaming servers 410 may not directly accept wagers or issue payouts. That is, the gaming servers 410 may facilitate online casino gaming but may not be part of a self-contained online casino itself. Another entity (e.g., a casino or any account holder or financial system of record) may operate and maintain its external account service 432 to accept bets and make payout distributions. The gaming servers 410 may communicate with the account service 432 to verify the existence of funds for wagering and to instruct the account service 432 to execute debits and credits. As another example, the gaming servers 410 may directly accept bets and make payout distributions, such as in the case where an administrator of the gaming servers 410 operates as a casino.

Additional features may be supported by the gaming servers 410, such as hacking and cheating detection, data storage and archival, metrics generation, messages generation, output formatting for different end user devices, as well as other features and operations. For example, the gaming servers 410 may include additional features and configurations as described in U.S. patent application Ser. No. 13/353,194, filed Jan. 18, 2012, now U.S. Pat. No. 9,120,007, issued Sep. 1, 2015, and U.S. patent application Ser. No. 13/609,031, filed Sep. 10, 2012, now U.S. Pat. No. 8,974,305, issued Mar. 10, 2015, both applications titled "NETWORK GAMING ARCHITECTURE, GAMING SYSTEMS, AND RELATED METHODS," the disclosure of each of which is incorporated herein in its entirety by this reference.

Figure 5:
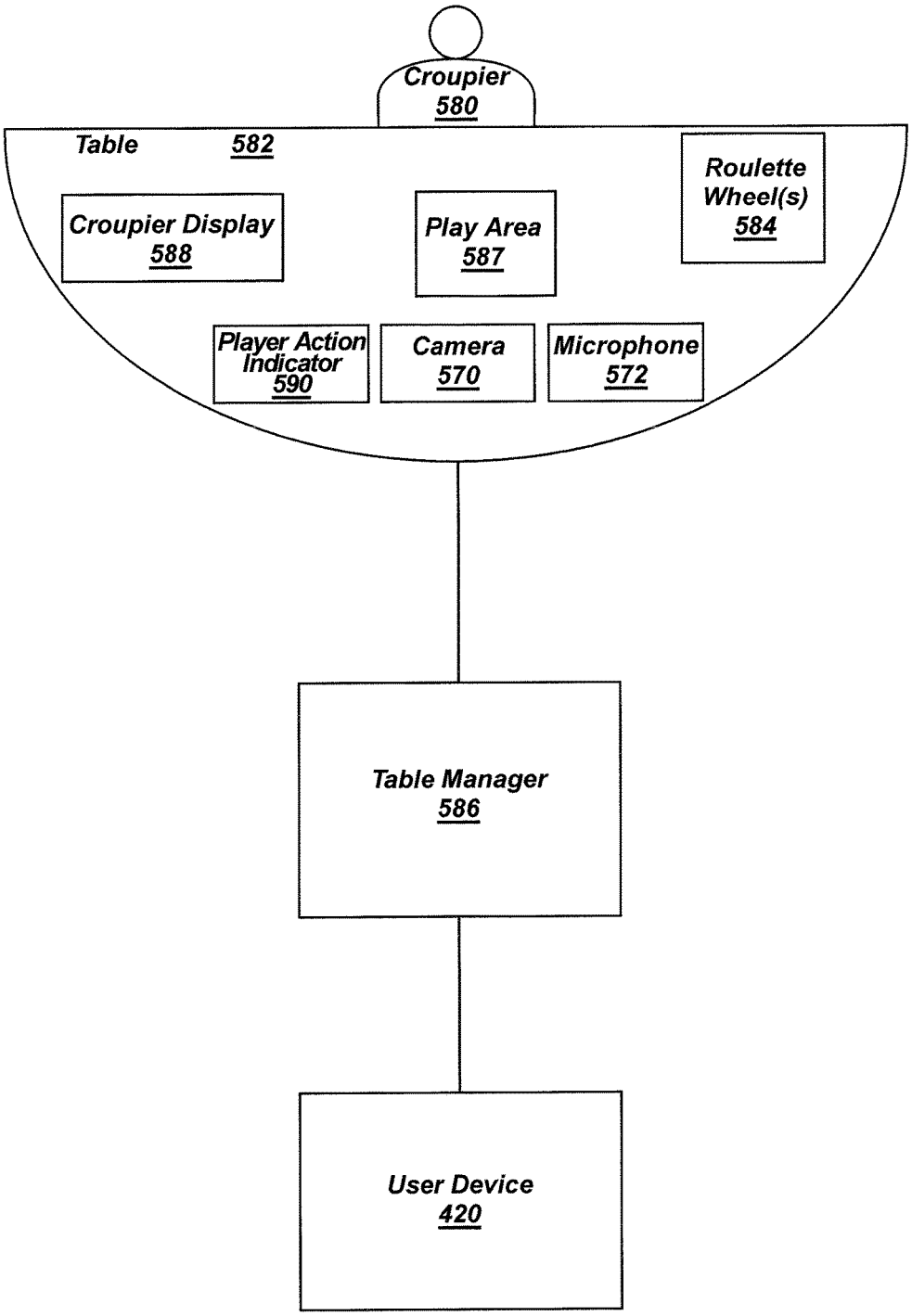
FIG. 5 is a schematic block diagram of a gaming system for implementing embodiments of wagering games including a live croupier feed.

FIG. 5 is a schematic block diagram of an exemplary system for implementing wagering games including a live croupier feed. Features of the gaming system 400 described above in connection with FIG. 4 may be utilized in connection with this embodiment, except as further described. Rather than roulette outcomes being generated by a computerized random processes, a physical outcome identifier or identifiers (e.g., balls or marbles) may be introduced into one or more corresponding physical roulette wheels 584 by a live croupier 580 at a table 582. A table manager 586 may assist the croupier 580 in facilitating play of the game by transmitting a video feed of the croupier's actions to the user device 420 and transmitting player elections to the croupier 580. As described above, the table manager 586 may act as or communicate with a gaming system 400 (see FIG. 4) (e.g., acting as the gaming system 400 (see FIG. 4)) itself or as an intermediate client interposed between and operationally connected to the user device 420 and the gaming system 400 (see FIG. 4) to provide gaming at the table 582 to users of the gaming system 400 (see FIG. 4). Thus, the table manager 586 may communicate with the user device 420 through a network 430 (see FIG. 4), and may be a part of a larger online casino, or may be operated as a separate system facilitating game play. In various embodiments, each table 582 may be managed by an individual table manager 586 constituting a gaming device, which may receive and process information relating to that table. For simplicity of description, these functions are described as being performed by the table manager 586, though certain functions may be performed by an intermediary gaming system 400 (see FIG. 4), such as the one shown and described in connection with FIG. 4. In some embodiments, the gaming system 400 (see FIG. 4) may match remotely located players to tables 582 and facilitate transfer of information between user devices 420 and tables 582, such as wagering amounts and player option elections, without managing gameplay at individual tables. In other embodiments, functions of the table manager 586 may be incorporated into a gaming system 400 (see FIG. 4).

The table 582 includes a camera 570 and optionally a microphone 572 to capture video and audio feeds relating to the table 582. The camera 570 may be trained on the croupier 580, play area 587, and roulette wheel or wheels 584. As the game is administered by the croupier 580, the video feed captured by the camera 570 may be shown to the player using the user device 420, and any audio captured by the microphone 572 may be played to the player using the user device 420. In some embodiments, the user device 420 may also include a camera, microphone, or both, which may also capture feeds to be shared with the croupier 580 and other players. In some embodiments, the camera 570 may be trained to capture images of the roulette outcomes, chips, and chip stacks on the surface of the gaming table 582. Known image extraction techniques may be used to obtain roulette outcome from the images of the roulette wheel or wheels 584. An example of suitable image extraction software is disclosed in U.S. Pat. No. 7,901,285, issued Mar. 8, 2011, to Tran et al., the disclosure of which is incorporated in this disclosure in its entirety by this reference.

Roulette outcome data in some embodiments may be used by the table manager 586 to determine game outcome. The data extracted from the camera 570 may be used to confirm roulette outcome data obtained from the roulette wheel or wheels 584 (e.g., using sensors) and for general security monitoring purposes, such as detecting player or croupier outcome or wager manipulation, for example. Examples of roulette outcome data include, for example, number and color information of a roulette outcome and number and color information of each roulette outcome in a set of roulette outcomes (e.g., three roulette outcomes from the same round of play).

The live video feed permits the croupier 580 to use one or more physical roulette wheels 584 and play the game as though the player were at a live casino. In addition, the croupier 580 can prompt a user by announcing a player's election is to be performed. In embodiments where a microphone 572 is included, the croupier 580 can verbally announce action or request an election by a player. In some embodiments, the user device 420 also includes a camera or microphone, which also captures feeds to be shared with the croupier 580 and other players.

Player elections may be transmitted to the table manager 586, which may display player elections to the croupier 580 using a croupier display 588 and player action indicator 590 on the table 582. For example, the croupier display 588 may display information regarding when to close betting, when to introduce an outcome identifier into a physical, spinning roulette wheel 584, or which player position is responsible for the next action.

In some embodiments, the table manager 586 may receive roulette outcome information from each roulette wheel 584. For example, the roulette wheel or wheels 584 may include sensors to detect specific spaces on the roulette wheel and which space an outcome identifier is positioned on. In some embodiments, the table manager 586 may generate roulette outcome information (e.g., alone or in addition to the information received from one or more roulette wheels 584).

The table manager 586 may apply game rules to the roulette outcome information, along with the accepted player decisions, to determine gameplay events and wager results. Alternatively, the wager results may be determined by the croupier 580 and input to the table manager 586, which may be used to confirm automatically determined results by the gaming system.

Roulette outcome data in some embodiments may be used by the table manager 586 to determine game outcome. The data extracted from the camera 570 may be used to confirm the data obtained from the roulette wheel or wheels 584 and for general security monitoring purposes, such as detecting player or croupier outcome or wager manipulation, for example.

The live video feed permits the croupier 580 to physically generate one or more randomized roulette outcomes and play the game as though the player were at a live casino. In addition, the croupier 580 can prompt a user by announcing a player's election is to be performed. In embodiments where a microphone 572 is included, the croupier 580 can verbally announce action or request an election by a player. In some embodiments, the user device 420 also includes a camera or microphone, which also captures feeds to be shared with the croupier 580 and other players.

Figure 6:
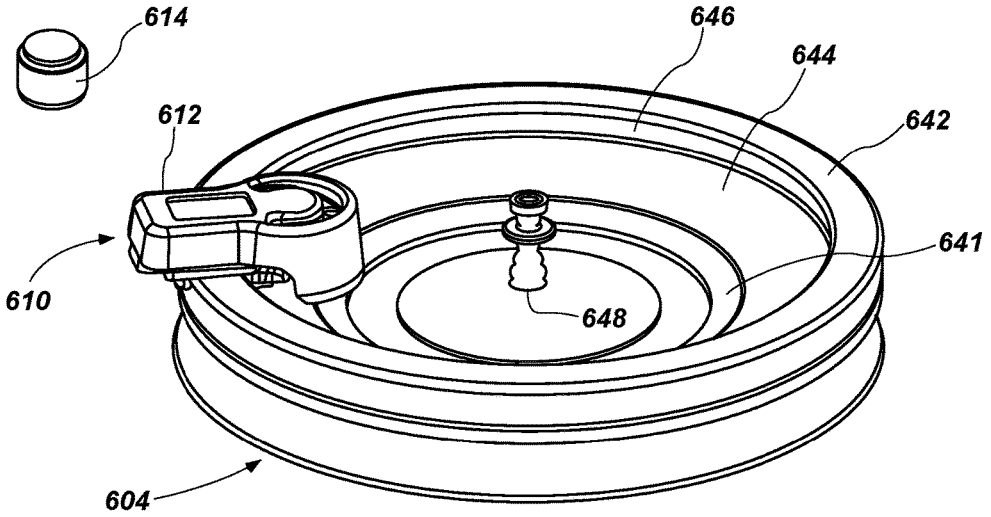
FIG. 6 is a perspective view of a roulette wheel with an embodiment of the present disclosure mounted thereon.

FIG. 6 shows an embodiment of the present disclosure mounted to the rim of a roulette wheel 604. Roulette wheel 604 is shown here for example only and other styles and designs of roulette wheels may be substituted while still supporting the concepts of the invention.

A conventional roulette wheel such as the roulette wheel 604 may comprise several components including a concave bowl 644 in which a wheelhead 641 spins. The wheelhead 641 may be a platter within the concave bowl 644 that has numbered slots into which the roulette ball eventually lands. Extending upward from the center of the wheelhead 641 is a turret 648. The concave bowl 644 is capped by a circumferential top rim 642. At the top of the concave bowl 644 and underneath the top rim 642 is a circular ball track 646. In typical play, a roulette ball is introduced into the ball track 646 and spun around the ball track 646. After several rotations around the ball track 646, the roulette ball begins to slow down and gravity causes it to drop out of the ball track 646 into the lower parts of the concave bowl 644. Eventually, the roulette ball falls into the wheelhead 641 (which is typically spinning in the opposite direction as the roulette ball) and then settles into one of the numbered slots indicating the winning outcome of the basic roulette game.

The embodiment of the present disclosure shown in FIG. 6 is a rim-mounted ball-launching system 610. As shown, the system 610 attaches to the top rim 642 of the roulette wheel 604 and partially overhangs the top rim 642, extending over the concave bowl 644. The system 610 includes a cover 612 that encloses many of the various system components and provides some aesthetic contouring as well as protection from dirt, spilled drinks, etc. The system 610 further includes a remote switch 614 that activates a ball launch. The remote switch 614 may be provided to a player to activate a ball launch and may be passed from player to player in turn during successive plays of the roulette game. The remote switch 614 is wirelessly connected to a launch system controller via various wireless communication protocols, for example, BLUETOOTH®. Other embodiments may include a remote switch having a wired connection, may provide multiple remote switches, or may not include a remote switch.

Figure 7:
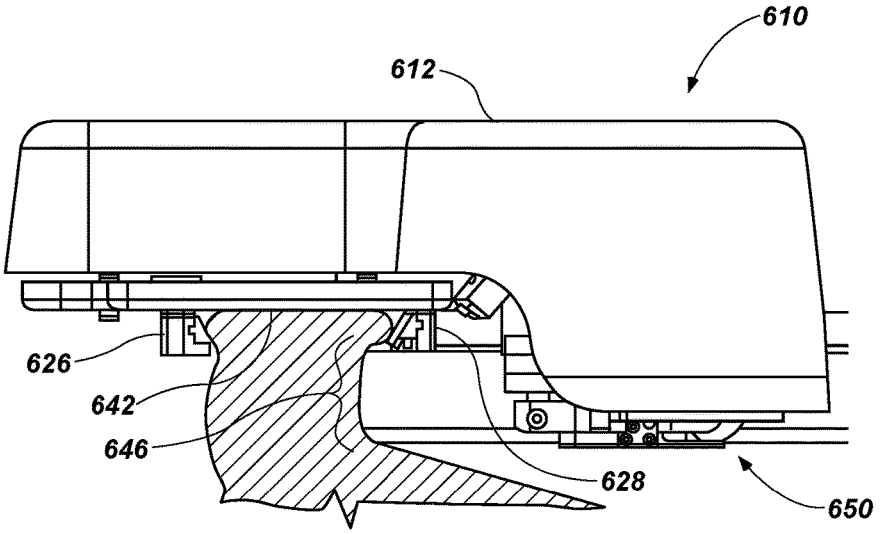
FIG. 7 is a side view of an embodiment of the present disclosure mounted to the top rim of a roulette wheel bowl.

FIG. 7 is a side view of the ball-launching system 610 mounted to a roulette wheel top rim 642. Various elements of a mounting structure are seen in FIG. 7, including an outer jaw bar 626 and an inner jaw bar 628 positioned, respectively, on outer and inner sides of the top rim 642. The system 610 is seen with a decorative cover 612 that conceals some of the working components of the ball-launching system 610. Although most of a ball launcher 650 is hidden by the cover 612, it is evident that the portion of the system 610 that overhangs the top rim 642 positions the launching device 650 proximate to the ball track 646. Various types of ball launchers may be employed with the ball-launching system 610. An exemplary (and non-limiting) ball launching device is described in the abovementioned U.S. patent application Ser. No. 14/865,592, which is incorporated herein by reference in its entirety.

Figure 8:
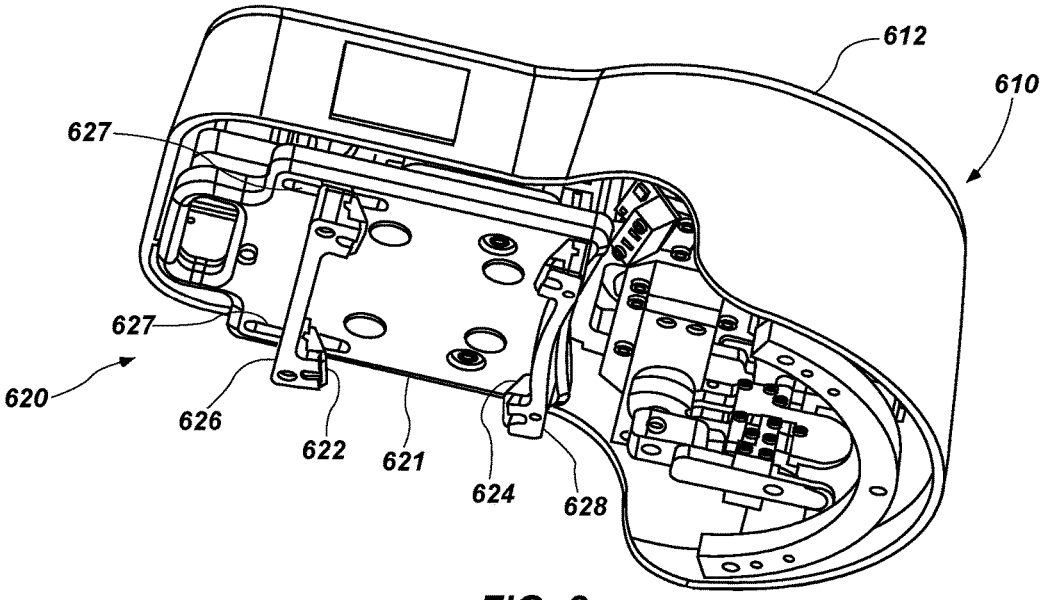
FIG. 8 is a perspective view of the underside of an embodiment of the present disclosure.

The perspective view shown in FIG. 8 reveals components on the underside of the ball-launching system 610. For example, a mounting structure 620 including the outer jaw bar 626 and the inner jaw bar 628 is evident in FIG. 8. The jaw bars 626, 628 are connected to a platform 621 and include respective outer jaws 622 and inner jaws 624. Adjustment means such as the slots 627 provide adjustability when clamping the inner and outer jaw bars 628, 626 to the top rim 642 (see FIG. 7) of a roulette wheel. In use, the ball-launching system 610 may be positioned with the platform 621 on the top rim 642 (see FIG. 7) with the inner jaws 624 abutting an inner surface of the top rim, and the outer jaws 622 may be moved via the adjustment slots 627 to clamp the top rim between the inner and outer jaws 624, 622.

The exemplary inner and outer jaw bars 628, 626 each respectively support two of the inner jaws 624 and the outer jaws 622, however, ball-launching systems with different numbers of inner and outer jaws are envisioned by the disclosure, as well as systems having jaws that mount directly without a jaw bar. Inner and outer jaws may be constructed of various materials. It may be preferable to utilize resilient and/or non-marring materials for the jaws, such as plastic, rubber, and other synthetic and natural materials, composites, and combinations thereof.

The novel rim-mounted configuration of embodiments of the disclosure enable a casino or other wagering-game establishment to include ball-launching systems with existing roulette wheels without requiring expensive and/or irreversible modifications to their roulette wheels. By clamping to the top rim of the roulette bowl, the ball-launching system 610 is both easily installed and easily removed from the roulette wheel. Once removed, the roulette wheel is restored to its previous condition due, in part, to the non-invasive attachment facilitated by the inner/outer jaw clamping attachment method.

Figure 9:
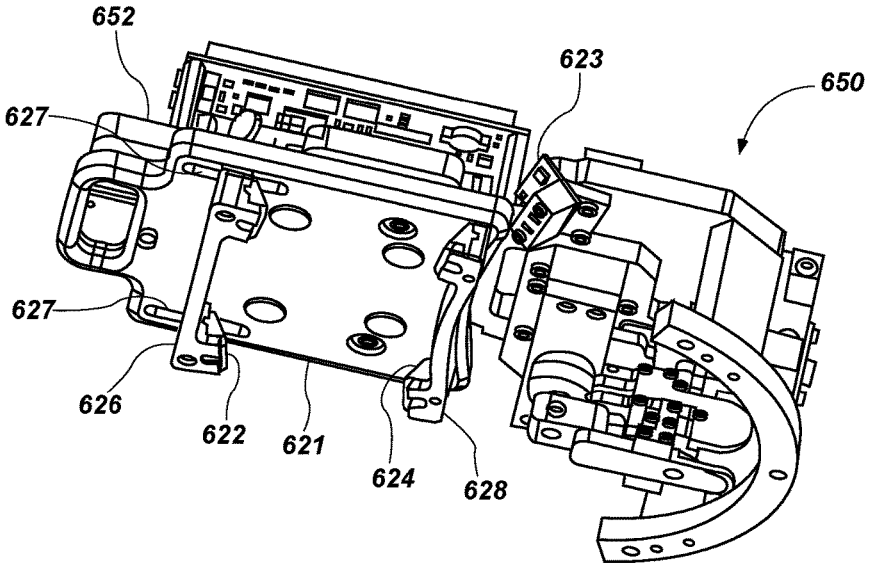
FIG. 9 is a perspective view of the underside of an embodiment of the present disclosure with the cover removed.

FIG. 9 shows the same view as FIG. 8 with the cover of the ball-launching system removed to expose some additional components. A base plate 652 carries some components of the ball launcher 650 and facilitates adjustment of the ball launcher with respect to the ball track. Also shown is a detector 623 that may be utilized to track roulette ball speed and direction after the ball has been launched into the ball track, and to count the number of rotations of the ball around the ball track. In an embodiment, the detector 623 may be further used to track wheelhead spin direction and a detector may even determine which numbered slot a roulette ball falls into. A detector 623 may be positioned differently on the ball-launching system than is seen in FIG. 9.

Various embodiments of the disclosure may utilize the detector 623 or one or more additional detectors to implement additional features. For example, detectors may be employed by the ball-launching system to detect the direction in which the wheelhead is spinning and the direction that the ball launcher aims to launch the roulette ball. If the respective directions are not compatible (e.g., the ball and the wheel typically spin in opposite directions), the ball-launching system may provide an alert to inform the dealer or croupier of an impending error. The alert may be an audio alert via a speaker or other audio device, and may be a video alert displayed on a display device such as the video display 130 (see FIG. 1), the video display 310 (see FIG. 3), or a dedicated croupier display 588 (see FIG. 5). Various other alert methods are considered to fall within the inventive aspects of the disclosure.

An embodiment of the present disclosure may include the capability of detecting the final positions of multiple roulette balls launched in a single spin of the roulette wheel. For example, a detector may be employed to capture a dynamic video image of the roulette wheel as multiple balls are launched into the ball track. One or more detectors may be cameras, such as the camera 570 (see FIG. 5). Video signal processing by the ball-launching system may track the respective (and changing) positions of the multiple balls and detect their final positions in the slots of the wheelhead. The final positions may be displayed on one or more display devices and data associated with the motion of the multiple balls and final positions may be stored by the ball-launching system. The system may display historical data related to ball positions from previous launches on one or more display devices for viewing by players and croupiers. Other detectors may employ other detecting methods to track and determine ball positions of balls launched into the roulette wheel.

In an embodiment, one or more detectors may monitor changes in light levels as a roulette ball rotates in the ball track. Two detectors in succession can determine ball direction and speed by noting sequence and elapsed time between respective detections. In a similar fashion, a detector may identify differences in reflected light from an empty slot and a slot containing a roulette ball. A detector may locate a reference point (e.g., a zero or double zero slot) and count subsequent slots as the wheel spins. In this manner, an embodiment may determine which particular slot (i.e., number and color) into which the roulette ball falls. Of course, various means and methods may be utilized to track ball and slot characteristics on the roulette wheel. Multi-colored balls may be used to facilitate tracking multiple balls in a single launch. A camera, such as the camera 570, may image the roulette wheel during spins and image-processing software may dynamically track multiple balls as they spin in the bowl and land in slots on the wheelhead. These and other similar means and methods for ball and wheel tracking are considered to be within the scope and spirit of the present disclosure.

Figure 10:
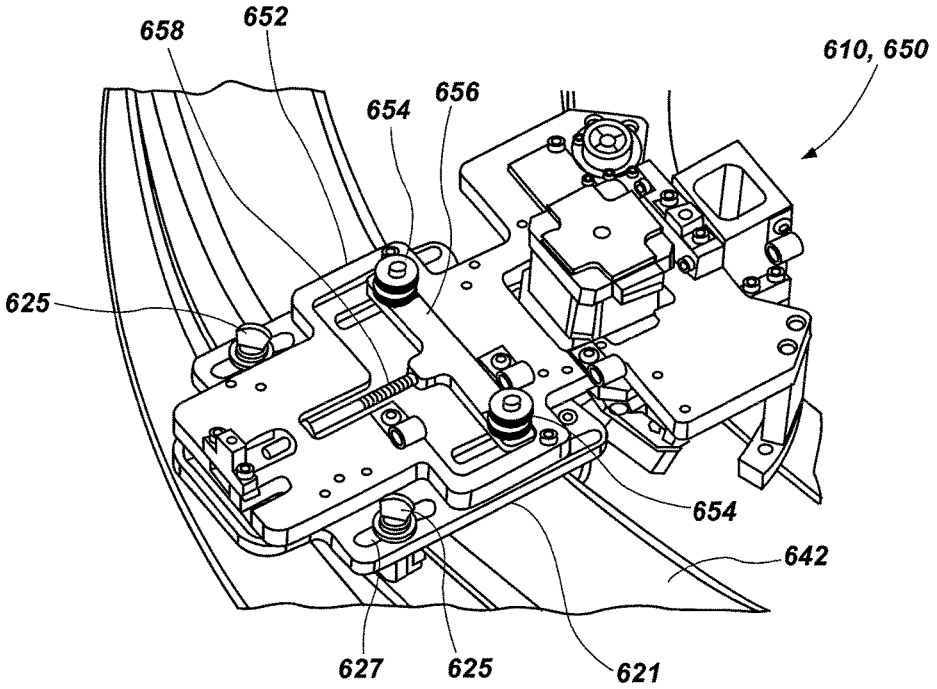
FIG. 10 is a perspective view of the top side of an embodiment of the present disclosure mounted to the top rim of a roulette wheel bowl.

FIG. 10 shows the ball-launching system 610 clamped to the top rim 642 of the roulette wheel with a portion of the ball launcher 650 overhanging the concave bowl. Thumb screws 625 in the slots 627 may lock the outer jaw bar 626 (see FIGS. 7-9) in place to facilitate a firm mounting connection to the top rim 642. An adjustment screw 658 may move the base plate 652 back and forth with respect to the mounting platform 621 to position the ball launcher 650 proximate the ball track 646 as needed to provide a smooth and efficient ball launch (see FIG. 11). As shown in this view, adjustment screw 658 is fixed for free rotation in the base plate 652 and threaded into a yoke 656 that is fixed in position with respect to the platform 621. Turning the adjustment screw 658 causes the base plate 652 to translate with respect to the platform 621 along a centerline of the adjustment screw 658. Once the base plate 652 (and the attached ball launcher 650) is correctly positioned to place a roulette ball 649 directly in the ball track 646 (see FIG. 11), the thumbnuts 654 are tightened to firmly clamp the base plate 652 to the platform 621.

Figure 11:
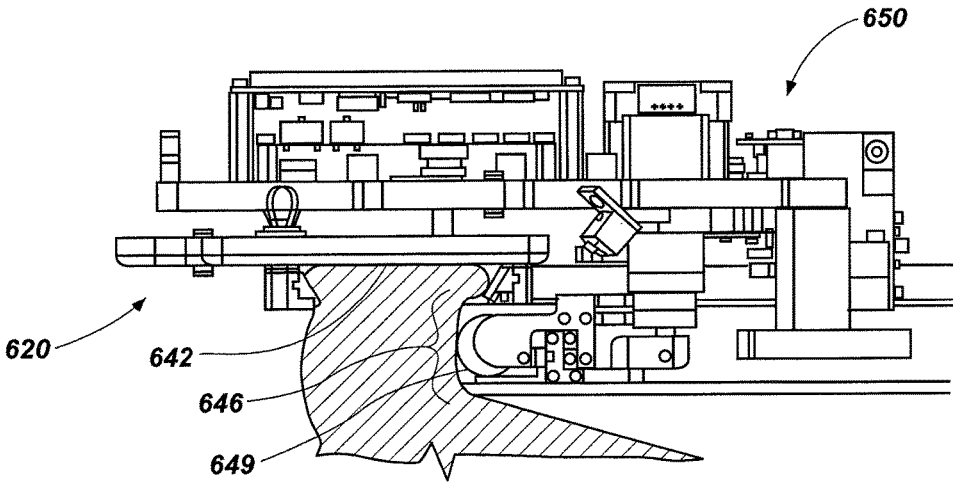
FIG. 11 is a side view of an embodiment of the present disclosure mounted to the top rim of a roulette wheel bowl.

In FIG. 11, an embodiment of the ball-launching system is shown mounted to the top rim 642 of a roulette wheel. In particular in this view, the ball launcher 650 is in position to launch the roulette ball 649 directly into the ball track 646 underneath the top rim 642. As seen here, prior to launching the roulette ball 649, a portion of the ball launcher 650 extends into the ball track 646, which allows the ball launcher 650 to smoothly launch the roulette ball nearly tangentially to the circular ball track 646. Prior to use, the ball launching system may be adjusted as described above to provide an optimal distance between the roulette ball 649 captured in the ball launcher 650 and the surface of the ball track 646. Typically, the ball launching system may be adjusted to ensure that the ball launcher releases the ball at or near a launch position that is tangential to and within the circular ball track. The tangential launch point within the ball track minimizes impact as the ball contacts the ball track—reducing noise as well as minimizing any bounce or other disruptions to a smooth, efficient launch process. In this embodiment, and possibly others, the configuration of the ball launcher enables the system to place the roulette ball directly into the circular ball track during a launch sequence. In particular, the ball and part of the ball launcher physically obstruct the ball track prior to the ball launcher releasing the ball. After release, the ball launcher moves away to unblock the ball track (and allow the ball to circle the ball track freely).

Figure 12:
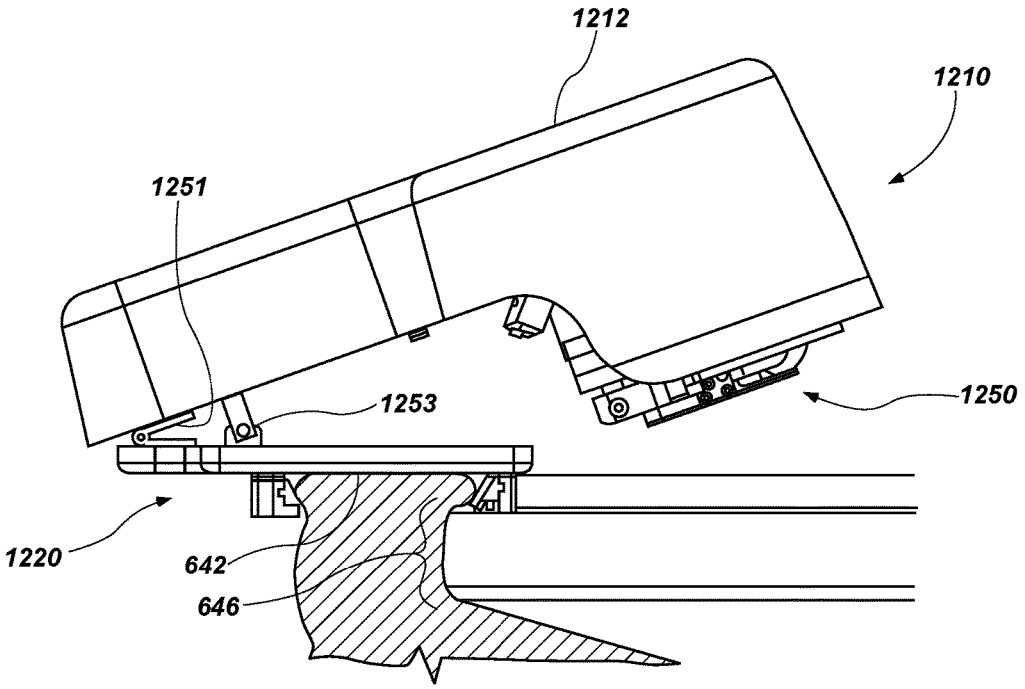
FIG. 12 is a side view of an embodiment of a pivoting ball-launching system with the ball launcher in the retracted position (i.e., withdrawn from the bowl).

In FIG. 12, an embodiment of the ball launching system 1220 of the present disclosure is shown mounted to the top rim 642 of the roulette wheel 604 (see FIG. 6). The ball-launching system 1210 may switch between a launch position (similar to that shown in FIG. 11) and a retracted position (as shown in FIG. 12). The ball-launching system 1210 is configured to pivot at least a part of the ball launcher 1250 upwards to move the ball launcher 1250 out of the concave bowl and away from the ball track 646. In the exemplary ball-launching system 1210, a hinge 1251 enables the ball launcher 1250 (including the cover 1212) to pivot upwards to withdraw the ball launcher 1250 out of the concave bowl. Ball-launching system 1210 further includes an actuator 1253 that may be activated to cause the ball launcher 1250 to withdraw from the concave bowl. In addition, an actuator may be configured to return the ball launcher 1250 to a launch position with a portion of the ball launcher 1250 extending into the concave bowl proximate to the ball track 646. In an embodiment configured differently than the embodiment described in FIG. 11, withdrawing the ball launcher from the roulette bowl after launching the ball may facilitate clearing the ball track to permit the roulette ball to circle the ball track freely. Additionally, moving the ball launcher to the retracted position may improve player views of the roulette wheel.

In an embodiment, the ball launcher withdraws linearly out of the bowl (as opposed to pivoting or rotating). Linear withdrawal may include linear movement in more than one direction, for example, an upwards movement combined with a lateral movement. Alternatively, the ball launcher may withdraw out of the bowl via a combination of linear and rotational movements, or via a combination of rotational movements in different directions. For example, the ball launcher 1250 may first pivot upwards as shown in FIG. 12 and then move radially away from the center of the bowl. Such a withdrawal sequence may provide a more complete withdrawal from the bowl and the player's sightlines into the bowl and may be preferred by some players. Or, the ball launcher 1250 may first pivot upwards as shown in FIG. 12 and then rotate about a vertical axis to completely withdraw beyond the opening of the bowl. All these withdrawal modes as well as various others and combinations thereof are considered to be in the spirit of the basic aspects of the disclosure.

Figure 13:
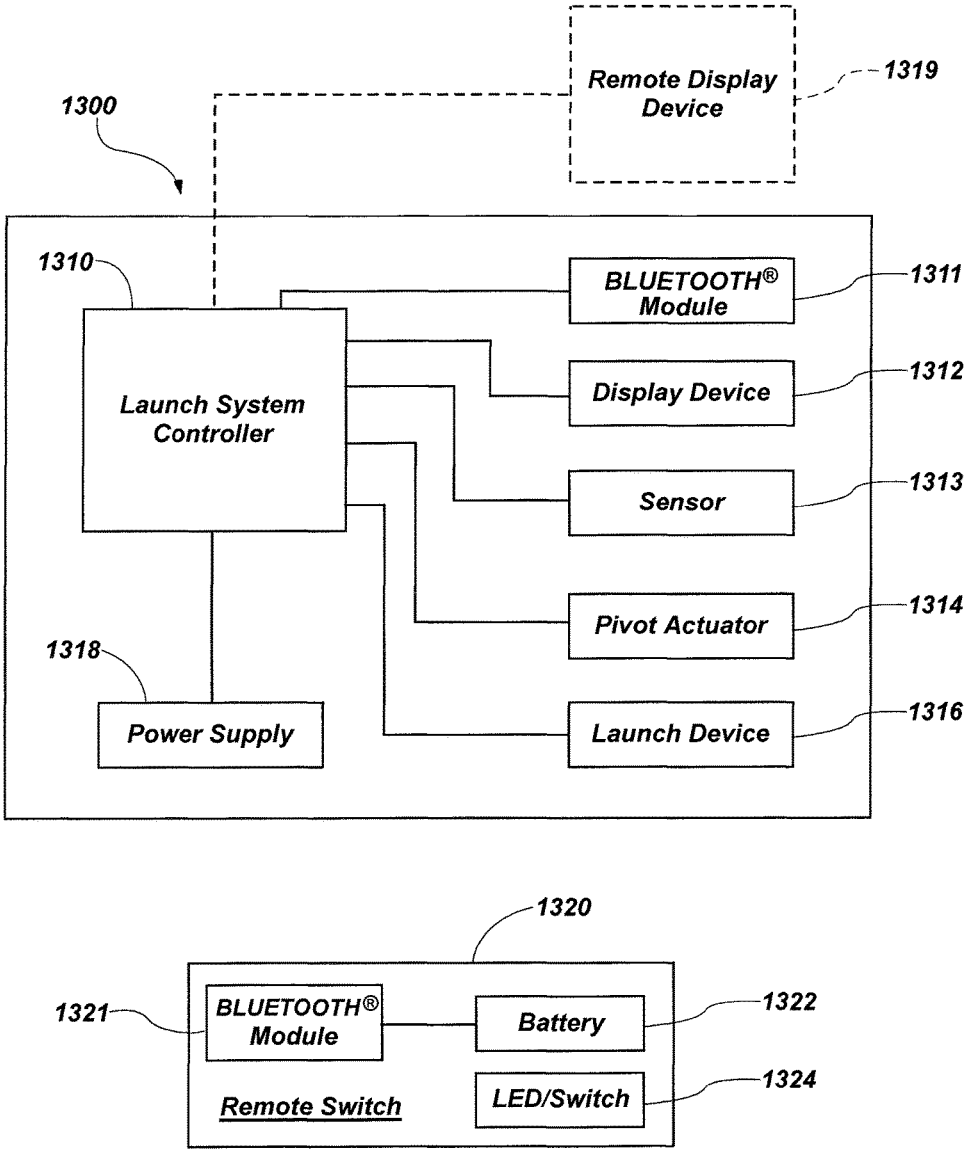
FIG. 13 is a schematic representation of an electronic architecture of an embodiment of the present disclosure.

FIG. 13 is a schematic depiction of an exemplary electronic architecture of an embodiment of the present disclosure. The ball-launching system 1300 includes a controller 1310 (e.g., one or more processors) connected to a power supply 1318 and controlling various system components. A display device 1312 may be mounted on the ball launcher to provide visual cues and information to the croupier and/or players. The ball-launching system 1300 may also control a remote display device 1319, for example, the table-mounted display device 130 as seen in FIG. 1 or the display device 310 as seen in FIG. 3. The sensor 1313 may track ball speed and direction after launch and may further monitor other characteristics such as wheel direction. The sensor 1313 may include one or more separate sensors. A pivot actuator 1314 may move a ball launcher from a launch position to a retracted position, from the retracted position to the launch position, and combinations thereof as well as additional different positions. A launch motor 1316 is activated to release a roulette ball into a ball track. A remote switch 1320 is wirelessly connected to the ball-launching system 1300 via BLUETOOTH® modules 1311, 1321 and is powered by a battery 1322. The remote switch 1320 further includes an LED/switch assembly 1324.

The various embodiments and examples described herein are provided by way of illustration only and should not be construed to limit the claimed invention, nor the scope of the various embodiments and examples. Those skilled in the art will readily recognize various modifications and changes that may be made to the claimed invention without following the example embodiments and applications illustrated and described herein, and without departing from the true spirit and scope of the claimed invention, which is set forth in the following claims. In addition, various embodiments may be combined. Therefore, reference to an embodiment, one embodiment, in some embodiments, in other embodiments, and the like does not preclude one or more methods, functions, steps, features, results, hardware implementations, or software implementations of different embodiments from being combined. Further, reference to an embodiment, one embodiment, in some embodiments, in other embodiments, examples, and the like provides various aspects that may or may not be combined with those of one or more different embodiments and/or examples.

While the example embodiments have been described with relation to a gaming environment, it will be appreciated that the above concepts can also be used in various non-gaming environments. Accordingly, the disclosure should not be limited strictly to gaming casinos, arcades, portal-based game sites, cellular phone devices, personal digital assistant devices, laptops, personal computers, home game consoles, bar top gaming devices, table gaming devices, surface computing devices, table gaming biometric touch-screens, television gaming, or in-room gaming devices.

The foregoing description, for purposes of explanation, uses specific nomenclature and formula to provide a thorough understanding of the disclosed embodiments. It should be apparent to those of skill in the art that the specific details are not required in order to practice the disclosed embodiments. The embodiments have been chosen and described to best explain the principles of the invention and its practical application, thereby enabling others of skill in the art to utilize the invention, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

What is claimed is:

1. A roulette ball launching system comprising:

a roulette table comprising a roulette wheel having a concave bowl with a circular ball track proximate and inside of the concave bowl, the bowl having a top overhanging rim adjacent to the circular ball track; and a roulette ball launcher assembly comprising:

a mounting structure comprising:

an outer jaw;

an inner jaw, the mounting structure attached to the bowl proximate the top rim by a portion of the bowl being clamped between the inner jaw and the outer jaw, wherein the inner jaw is positioned within the bowl;

a platform coupled to both the inner jaw and the outer jaw, the platform being movable in a radial direction relative to the circular ball track of the concave bowl when the mounting structure is clamped and radially secured onto the bowl; and a support plate coupled to and being movable relative to the platform; and a roulette ball launcher connected to the mounting structure, the ball launcher for positioning a stationary roulette ball in the circular ball track underneath the top rim prior to launching the roulette ball into the circular ball track, wherein movement of the support plate in the radial direction relative to the platform, the inner jaw, and the outer jaw enables the ball launcher to be positioned radially relative to the circular ball track of the concave bowl.

2. The roulette ball launching system of claim 1, wherein at least a part of the ball launcher is configured to extend into the circular ball track each time a roulette ball is launched into the circular ball track.

3. The roulette ball launching system of claim 1, wherein the ball launcher is configured to launch the ball in direct response to a player activating a remote switch.

4. The roulette ball launching system of claim 1, further comprising an adjustment component configured to change a position of the ball launcher with respect to the mounting structure after the mounting structure is fixed to the top rim of the concave bowl.

5. The roulette ball launching system of claim 1, further comprising an adjustment component configured to change a distance between at least part of the ball launcher and the circular ball track.

6. The roulette ball launching system of claim 1, wherein the ball launcher is configured to be adjustable along the platform and fixable to the platform.

* * * * *